US007770979B2

(12) United States Patent
He

(10) Patent No.: US 7,770,979 B2
(45) Date of Patent: Aug. 10, 2010

(54) ADJUSTING MECHANISM FOR ARM REST

(75) Inventor: Shiue-Yu He, Wuci Township (TW)

(73) Assignee: Wen Sang Plastics., Ltd., Cingshuei Township (TW)

( * ) Notice: Subject to any disclaimer, the term of this patent is extended or adjusted under 35 U.S.C. 154(b) by 13 days.

(21) Appl. No.: 12/333,896

(22) Filed: Dec. 12, 2008

(65) Prior Publication Data

US 2009/0278393 A1 Nov. 12, 2009

(30) Foreign Application Priority Data

May 7, 2008 (TW) ..... 97207908 U

(51) Int. Cl.
*A47C 7/54* (2006.01)

(52) U.S. Cl. ..... 297/411.36

(58) Field of Classification Search ..... 297/411.36
See application file for complete search history.

(56) References Cited

U.S. PATENT DOCUMENTS 5,265,938 A * 11/1993 Melhuish et al. ..... 297/411.36
5,318,347 A * 6/1994 Tseng ..... 297/411.36
6,062,647 A * 5/2000 Mei ..... 297/411.36
6,209,961 B1 * 4/2001 Chen ..... 297/411.36
6,460,932 B1 * 10/2002 Kopish et al. ..... 297/411.36
6,896,333 B1 * 5/2005 Matern et al. ..... 297/411.36
7,097,254 B2 * 8/2006 Hobb et al. ..... 297/411.36
2005/0146191 A1 * 7/2005 Machael et al. ..... 297/411.36
2008/0036264 A1 * 2/2008 Pan ..... 297/411.36
2008/0036265 A1 * 2/2008 Pan ..... 297/411.36
2008/0296955 A1 * 12/2008 Geister et al. ..... 297/411.36
2008/0309140 A1 * 12/2008 Ho ..... 297/411.36
2010/0033005 A1 * 2/2010 Lee ..... 297/411.36
2010/0038950 A1 * 2/2010 Lee ..... 297/411.36

* cited by examiner

*Primary Examiner*—Rodney B White
(74) *Attorney, Agent, or Firm*—Wang Law Firm; Li K. Wang

(57) ABSTRACT

An adjusting mechanism for adjusting arm rest of a chair includes an inner tube with an axial groove in an outside thereof and multiple positioning holes are located within the axial groove. An outer tube is mounted to the inner tube and an arm rest is connected to a top end of the outer tube. An engaging portion protrudes inward from an inside of the outer tube and movably engaged with the axial groove of the inner tube, so that the outer tube can be moved relative to the inner tube. An operation member is pivotably connected to the outer tube and includes a hook which extends through the outer tube and is engaged with one of the positioning holes. A guide plate is located above the hook and movably accommodated in a guide slot in the outer tube so that the operation member is operated in stable status.

6 Claims, 7 Drawing Sheets

ADJUSTING MECHANISM FOR ARM REST

FIELD OF THE INVENTION

The present invention relates to an adjusting mechanism for arm rest of a chair, and more particularly, to an adjusting mechanism which is easily to be maintained and operated.

BACKGROUND OF THE INVENTION

Most of the manager's chairs are equipped with an adjusting mechanism for adjusting the height of the seat, and some chairs even include an adjusting mechanism for adjusting the backrest to a desired tilt position. Nevertheless, the users are experienced that the arm rests are not adjusted relative to the seat and this cannot provide the users a comfort sitting environment.

As shown in FIG. 7, a conventional adjusting mechanism for adjusting the arm rest for chairs and generally includes an L-shaped frame 1 which includes a plurality of positioning holes 2 defined through the upright portion thereof. A sleeve 3 is movably mounted to the frame 1 and an arm rest 4 is connected to an open top of the sleeve 3. The open top of the sleeve 3 includes two flexible plates 5 connected to a top edge of the wall thereof and an operation member 6 is engaged with the open top of the sleeve 3. The operation member 6 includes a top end engaged with the flexible plates 5 and a hook member 7 extends laterally from a lower end of the operation member 6. The flexible plates 5 provide a biasing force to the operation member 6 to insert the hook member 7 with one of the positioning holes 2 to set the height of the arm rest 4. When adjusting the arm rest 4, the user pushes the operation member 6 to overcome the force of the flexible plates 5 and to remove the hook member 7 from the positioning hole 2, the sleeve 3 is then able to be move relative to the frame 1 till a desired height, the operation member 6 is released and the hook member 7 is engaged to another positioning hole 2.

The operation member 6 is located within the sleeve 3 and is difficult to be assembled. Besides, the whole arm rest unit has to be disassembled if an old part is to be replaced within the sleeve 3. This increases the cost for maintenance.

Because the operation member 6 has to be pushed frequently to adjust the height of the arm rest 4, the conjoint portion between the sleeve 3 and the operation member 6 is easily worn out and the operation member 6 shakes or swings during adjustment, sometimes, the hook member 7 cannot successfully engaged with the positioning hole 2.

Furthermore, when adjusting, the operation member 6 is pushed and the hook member 7 is disengaged from the positioning hole 2, the sleeve 3 can be completely pulled out from the frame 1.

SUMMARY OF THE INVENTION

The present invention relates to an adjusting mechanism for adjusting arm rest of a chair, and the mechanism comprises an inner tube having an axial groove in an outside thereof and multiple positioning holes are defined in the axial groove.

An outer tube is mounted to the inner tube and an engaging portion protrudes inward from an inside of the outer tube, the engaging portion is movably engaged with the axial groove of the inner tube. A through hole is defined through a wall defining the engaging portion and a support protrudes from an outside of the engaging portion. The through hole is in alignment with one of the positioning holes. A guide slot is located above the through hole.

An operation member has a mediate portion thereof pivotably connected to the support of the engaging portion so that the operation member is pivotable about the support. A hook extends from a lower end thereof and a guide plate is located above the hook. The guide plate is movably accommodated in the guide slot and the hook extends through the through hole and is engaged with one of the positioning holes. A spring is biased between the engaging portion and an inside of a top end of the operation member.

The primary object of the present invention is to provide an adjusting mechanism for adjusting arm rest of a chair, the mechanism is easily assembled.

Another object of the present invention is to provide an adjusting mechanism for adjusting arm rest of a chair, the mechanism can precisely set the arm rest to a desired height.

Yet another object of the present invention is to provide an adjusting mechanism for adjusting arm rest of a chair, the mechanism avoids the outer tube from being pulled out from the inner tube.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
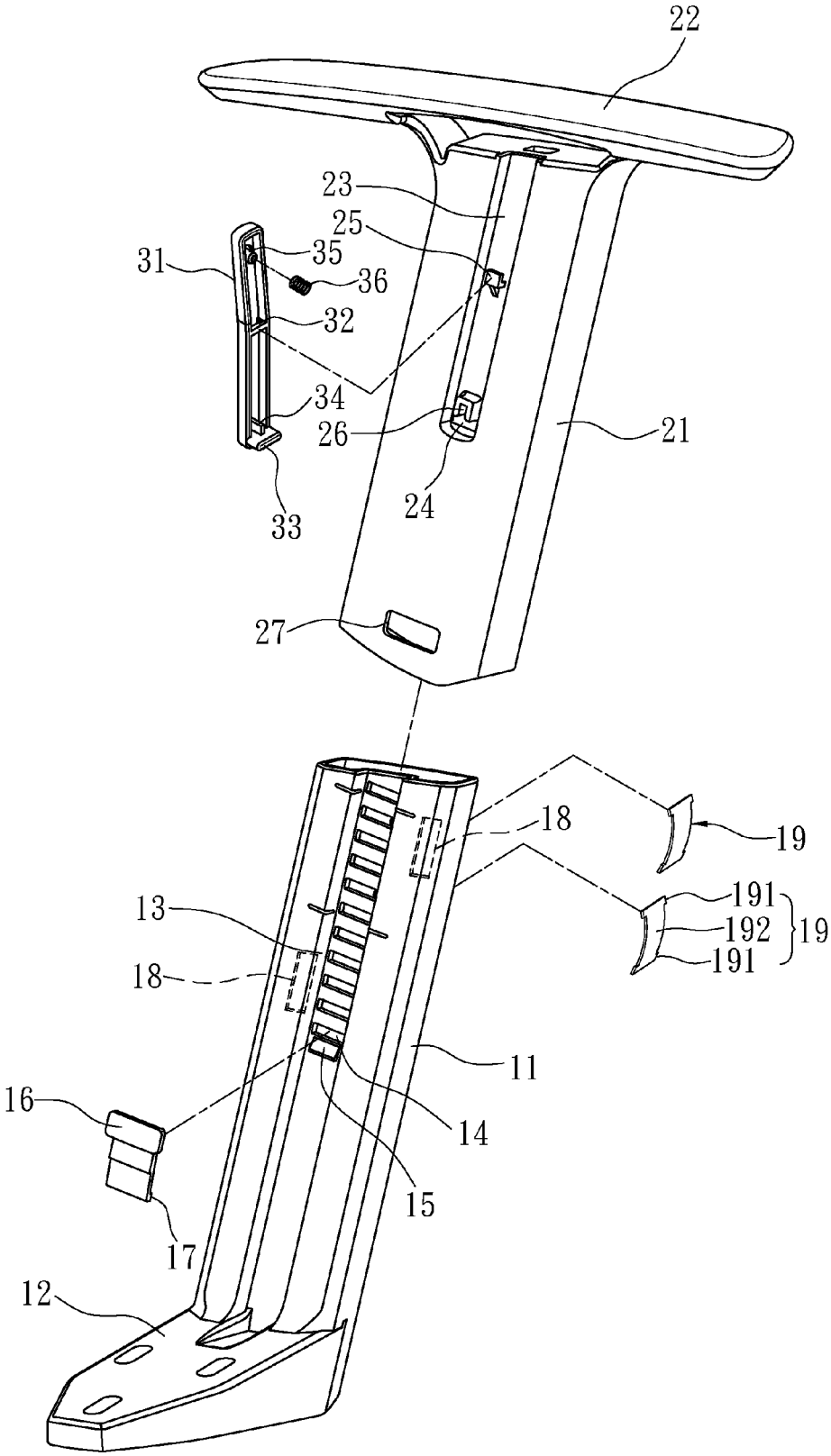
FIG. 1 is an exploded view to show the adjusting mechanism of the present invention.
Figure 2:
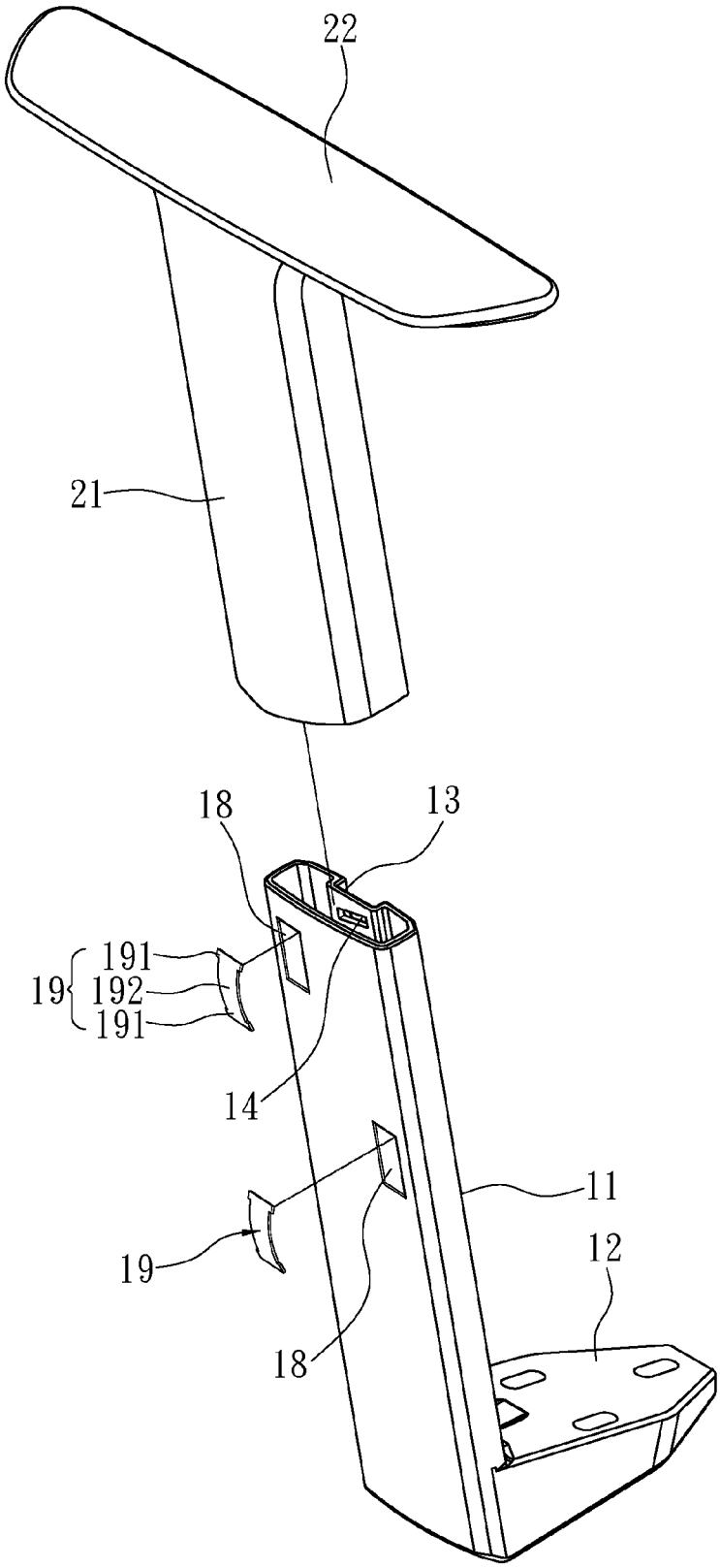
FIG. 2 is an exploded view of another angle of the adjusting mechanism of the present invention.
Figure 3:
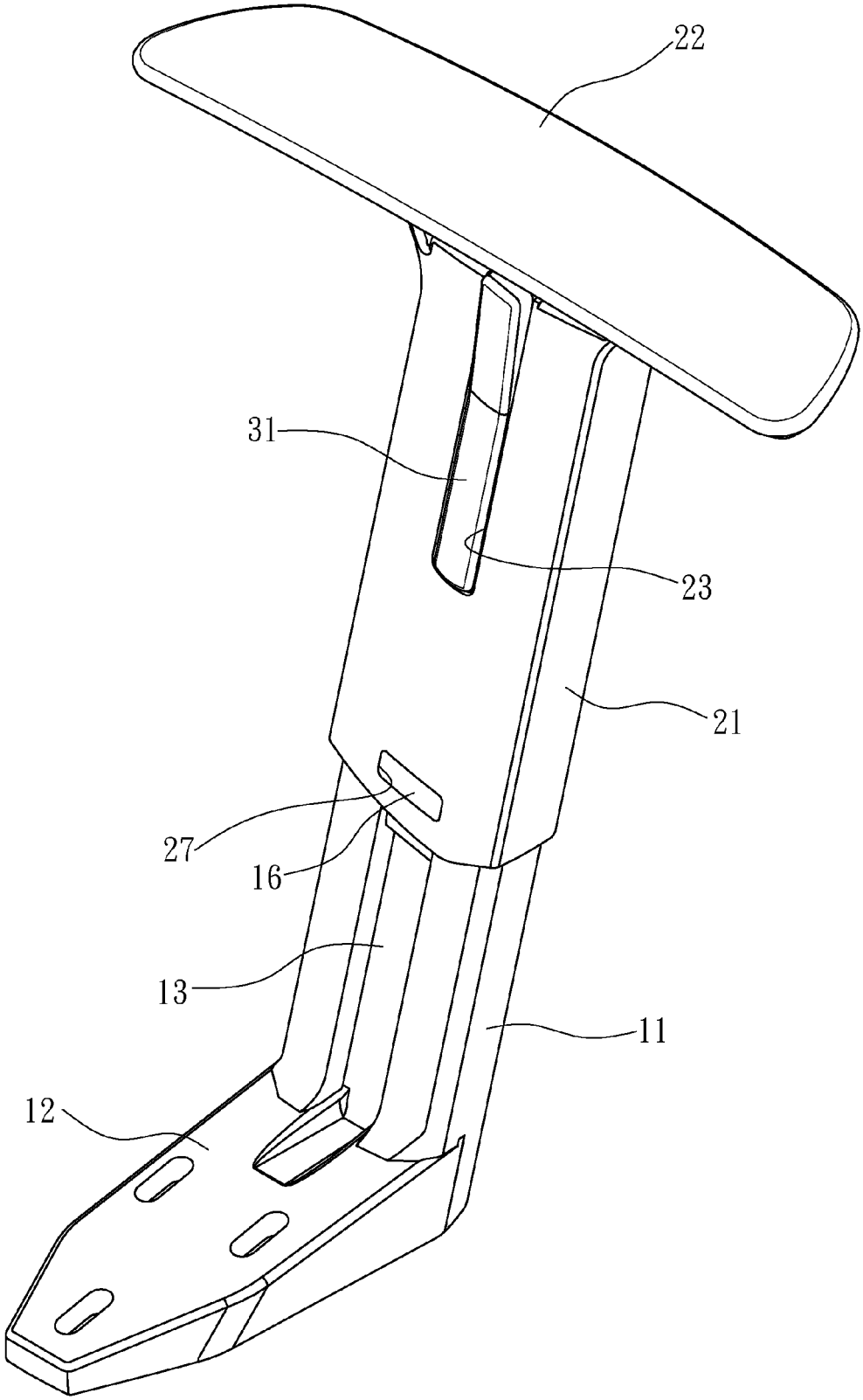
FIG. 3 is a perspective view to show the adjusting mechanism of the present invention.
Figure 4:
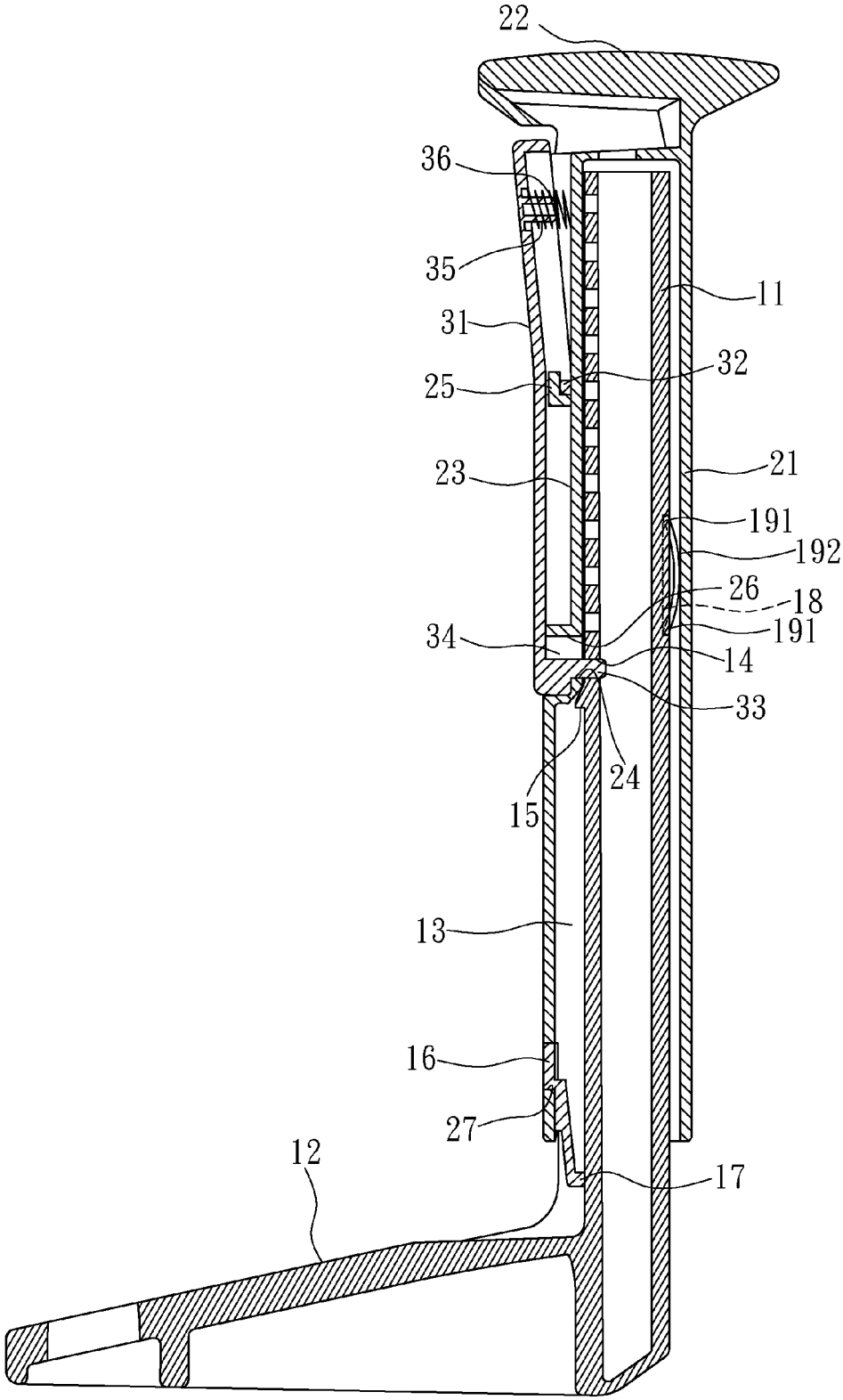
FIG. 4 is a side cross sectional view to show the adjusting mechanism of the present invention.

Referring to FIGS. 1 to 4, the adjusting mechanism for adjusting arm rest of a chair of the present invention comprises an inner tube 11 and an outer tube 21 which is mounted to the inner tube 11. The inner tube 11 has a connection portion 12 at a lower end thereof and the connection portion 12 is connected with the chair (not shown). An axial groove 13 is defined in an outside thereof and multiple positioning holes 14 are defined through a wall defining the axial groove 13. A first stop 15 extends from the inner end of the axial groove 13 and is located beneath the lowest positioning hole 13. A sliding member 16 is movably engaged with the axial groove 13 and has a second stop 17 which can be stopped by the first stop 15 in the axial groove 13. Two apertures 18 are defined through a wall of the inner tube 11 and two flexible plates 19 are engaged with apertures 18 respectively. Each flexible plate 19 includes engaging studs 191 extending from two sides thereof and the engaging studs 191 are engaged with the periphery of the apertures 18. Each of the flexible plates 19 includes a convex mediate portion which forms a contact surface 192.

The outer tube 21 is mounted to the inner tube 11 and an arm rest 22 is connected to a top end thereof. An engaging portion 23 protrudes inward from the inside of the outer tube 21 and is movably engaged with the axial groove 13 of the inner tube 11. An opening 27 is defined through a wall of the outer tube 21 and the sliding member 16 is engaged with the opening 27. When the outer tube 21 is moved relative to the inner tube 11, the engaging portion 23 slides within the axial groove 13 so that the movement of the outer tube 21 is well guided. The contact surfaces 192 of the flexible plates 19 protrude through the apertures 18 to contact the inside of the outer tube 21 to reinforce the connection between the inner and outer tubes 11, 21. A through hole 24 is defined through a wall defining the engaging portion 23 and located at a lower end of the engaging portion 23. A support 25 protrudes from an outside of the engaging portion 23 and is located at a mediate portion of the engaging portion 23. The through hole 24 is in alignment with one of the positioning holes 14. A part extends from the outside of the engaging portion 23 and defines a guide slot 26 which is located above the through hole 24.

An operation member 31 includes a frame 32 connected to the inside of the mediate portion of the operation member 31 and the frame 32 is pivotably connected to the support 25. The operation member 31 is pivotable relative to the support 25 of the engaging portion 23. A hook 33 extends from a lower end thereof and a guide plate 34 is located above the hook 33. The guide plate 34 is movably accommodated in the guide slot 26 and the hook 33 extends through the through hole 24 and is engaged with one of the positioning holes 14 to set the outer tube 21 relative to the inner tube 11. A spring 36 is biased between the engaging portion 23 and a protrusion 35 extending from an inside of a top end of the operation member 31. One end of the spring is mounted to the protrusion 35 and the other end is in contact with the engaging portion 23.

Figure 5:
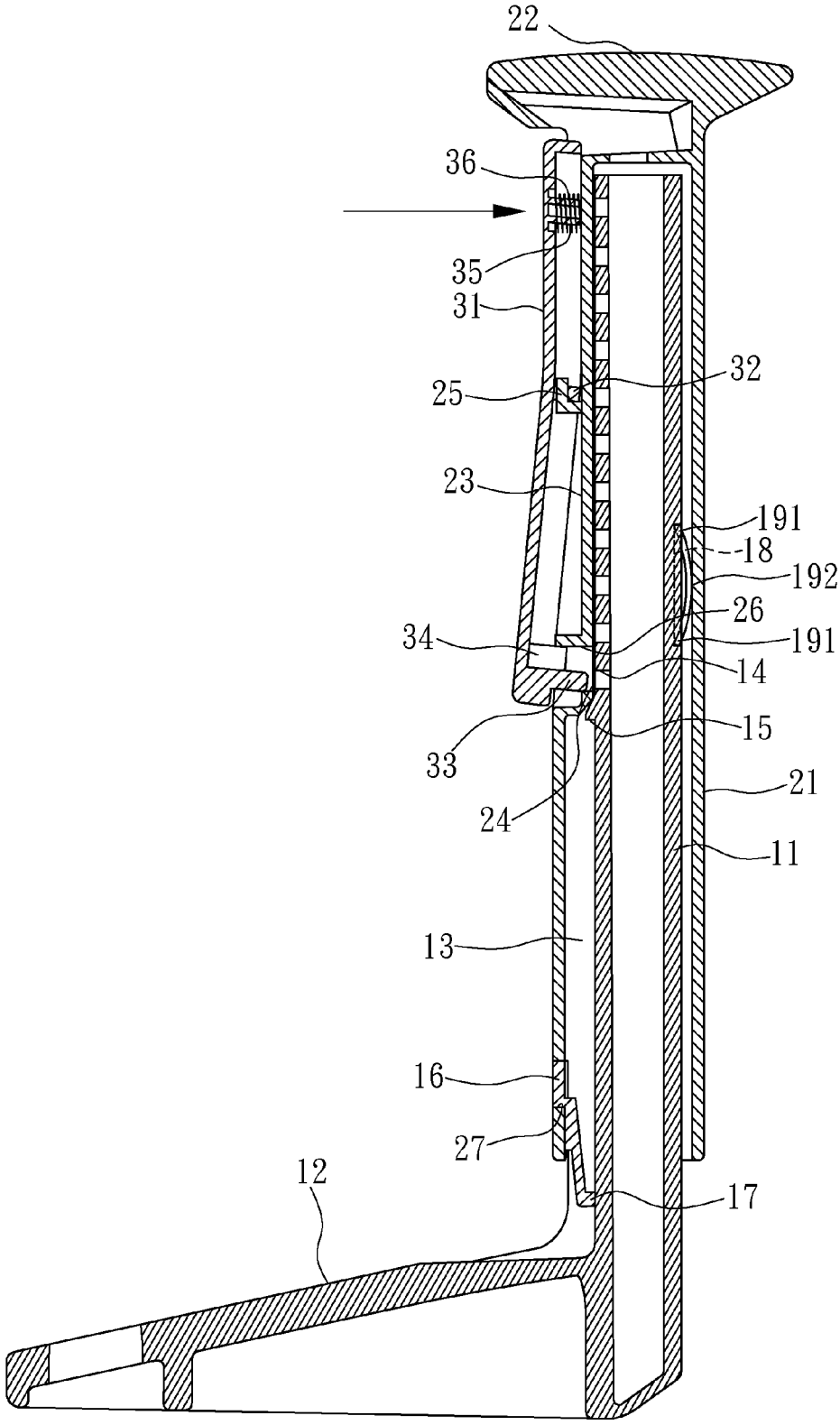
FIG. 5 is a side cross sectional view to show that the operation member is operated to allow the outer tube to be moved relative to the inner tube.

The spring 36 provides a force to insert the hook 33 into the through hole 24 in the outer tube 21 and one of the positioning holes 14 in the inner tube 11. By this way, the outer tube 21 is set relative to the inner tube 11. When the user pushes the operation member 31 to compress the spring 36 as shown in FIG. 5, the hook 33 is disengaged from the positioning hole 14, while the guide plate 34 is still accommodated within the guide slot 26. The outer tube 21 can then be moved relative to the inner tube 11 and moves to a desired height. The hook 33 is engaged with another positioning hole 14 when releasing the operation 31.

It is noted that the guide plate 34 is still accommodated within the guide slot 26 when pushing the operation member 31, so that the operation member 31 does not shake and swing during operation, and the hook 33 can be precisely engaged with the positioning hole 14.

Figure 6:
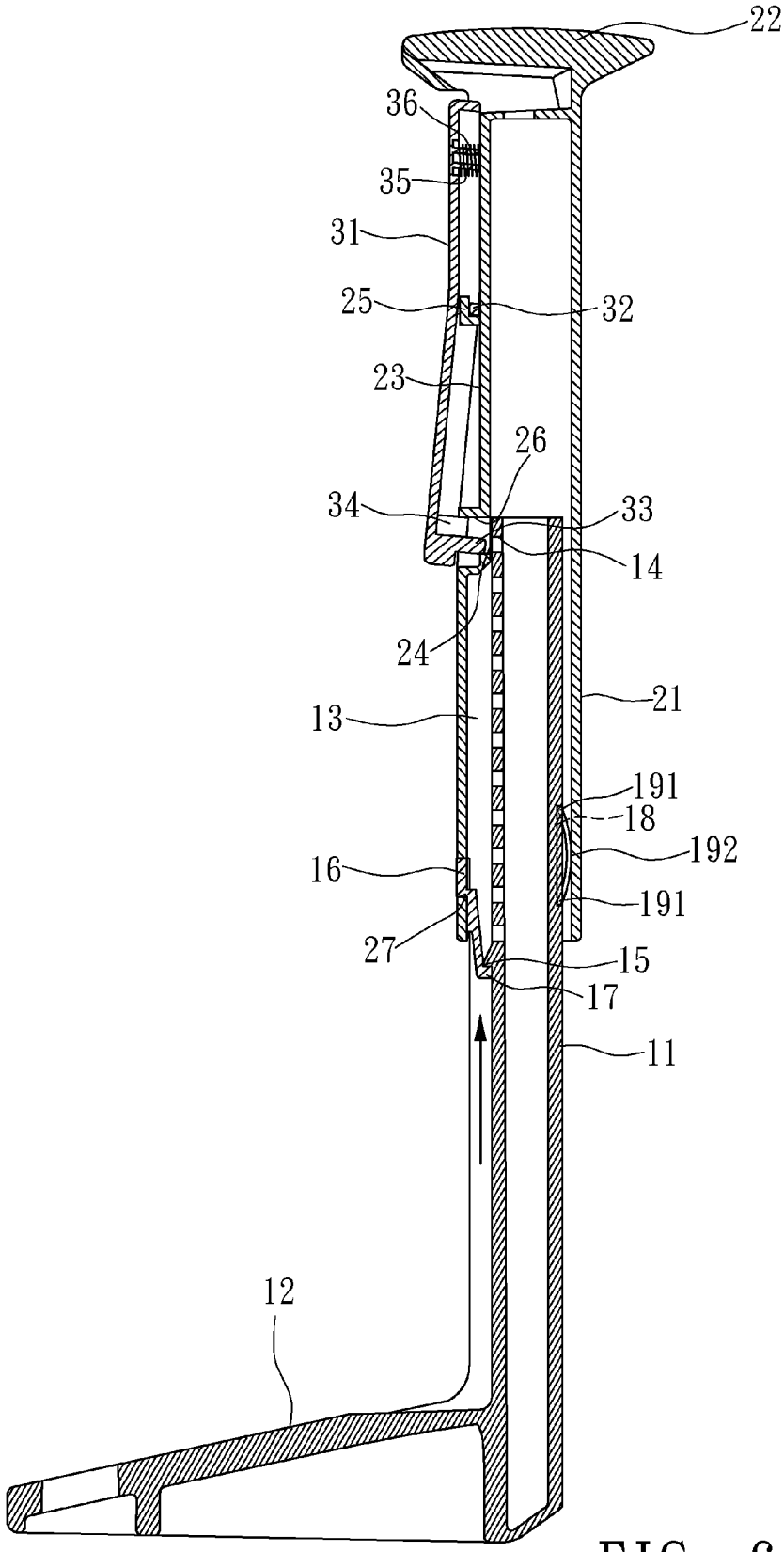
FIG. 6 is a side cross sectional view to show that the second stop on the sliding member is stopped by the first stop on the inner tube.
Figure 7:
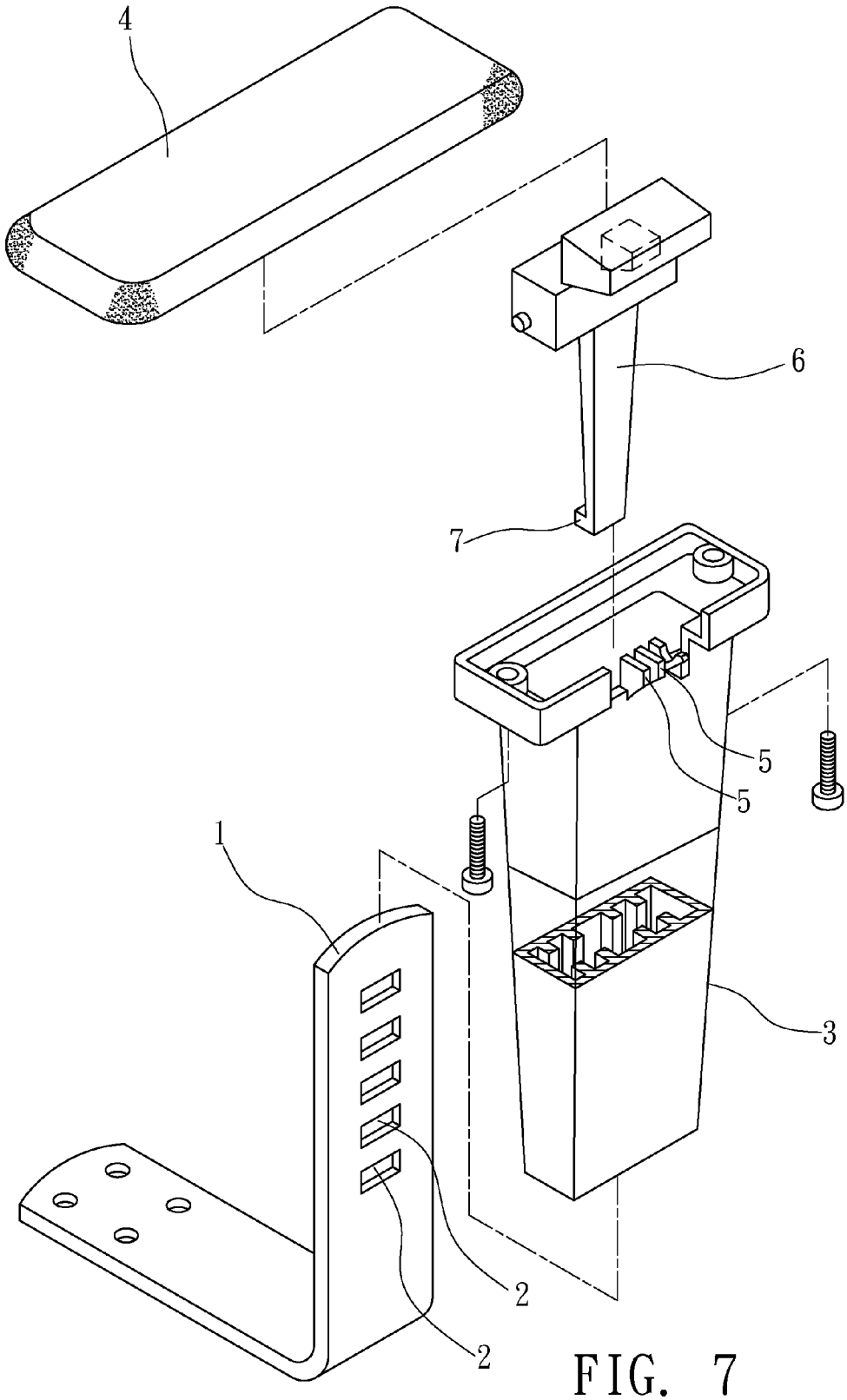
FIG. 7 PRIOR ART
FIG. 7 is an exploded view to show the conventional adjusting mechanism for arm rest.

As shown in FIG. 6, when pulling the outer tube 21, the sliding member 16 engaged with the opening 27 is moved with the movement of the outer tube 21. The second stop 17 is stopped by the first stop 15 to prevent the outer tube 21 from disengaging from the inner tube 11.

The operation member 31 is located on the outside of the outer tube 21 so that the maintenance is convenient without disassembling the whole arm rest unit of the chair. The guide plate 34 is accommodated within the guide slot 26 when adjusting the outer tube 21 relative to the inner tube 11, and this ensures that the operation member 31 does shake and swing to allow the hook 33 to be precisely engaged with the positioning hole 14. The axial groove 13 of the inner tube 11 includes a first stop 15 and the sliding member 16 has a second stop 17 which is stopped by the first stop 15 so that the outer tube 21 is not pulled out from the inner tube 11 when adjusting the height of the arm rest. When the outer tube 21 is mounted to the inner tube 11, the contact surfaces 192 of the flexible plates 19 are in contact with the inside of the outer tube 21 to provide a snug-fit between the inner and outer tubes 11, 21.

While we have shown and described the embodiment in accordance with the present invention, it should be clear to those skilled in the art that further embodiments may be made without departing from the scope of the present invention.

What is claimed is:

1. An adjusting mechanism for adjusting arm rest of a chair, comprising:

an inner tube having a connection portion at a lower end thereof and the connection portion adapted to be connected with the chair, an axial groove defined in an outside thereof and multiple positioning holes defined through a wall defining the axial groove;

an outer tube mounted to the inner tube and an arm rest connected to a top end thereof, an engaging portion protruding inward from an inside of the outer tube and movably engaged with the axial groove of the inner tube, a through hole defined through a wall defining the engaging portion and located at a lower end of the engaging portion, a support protruding from an outside of the engaging portion and located at a mediate portion of the engaging portion, the through hole being in alignment with one of the positioning holes, a part extending from the outside of the engaging portion and defining a guide slot which is located above the through hole, and an operation member having a mediate portion thereof pivotably connected to the support of the engaging portion so that the operation member is pivotable about the support, a hook extending from a lower end thereof and a guide plate located above the hook, the guide plate movably accommodated in the guide slot and the hook extending through the through hole and engaged with one of the positioning holes, a spring biased between the engaging portion and an inside of a top end of the operation member, wherein a first stop extends from the inner end of the axial groove and is located beneath the positioning holes, a sliding member is movably engaged with the axial groove and has a second stop, an opening is defined through a wall of the outer tube and the sliding member is engaged with the opening, the second stop is stopped by the first stop when the outer tube is moved relative to the inner tube to prevent the outer tube from disengaging from the inner tube.

2. The adjusting mechanism as claimed in claim 1, wherein a frame is connected to the inside of the mediate portion of the operation member and the frame is pivotably connected to the support.

3. The adjusting mechanism as claimed in claim 1, wherein a protrusion extends from the inside of the top end of the operation member and one end of the spring is mounted to the protrusion.

4. The adjusting mechanism for adjusting arm rest of a chair, comprising:

an inner tube having a connection portion at a lower end thereof and the connection portion adapted to be connected with the chair, an axial groove defined in an outside thereof and multiple positioning holes defined through a wall defining the axial groove;

an outer tube mounted to the inner tube and an arm rest connected to a top end thereof, an engaging portion protruding inward from an inside of the outer tube and movably engaged with the axial groove of the inner tube, a through hole defined through a wall defining the engaging portion and located at a lower end of the engaging portion, a support protruding from an outside of the engaging portion and located at a mediate portion of the engaging portion, the through hole being in alignment with one of the positioning holes, a part extending from the outside of the engaging portion and defining a guide slot which is located above the through hole, and an operation member having a mediate portion thereof pivotably connected to the support of the engaging portion so that the operation members is pivotable about the support, a hook extending from a lower end thereof and a guide plate located above the hook, the guide plate movably accommodated in the guide slot and the hook extending through the through hole and engaged with one of the positioning holes, a spring biased between the engaging portion and an inside of a top end of the operation member, wherein at least one aperture is defined through a wall of the inner tube and a flexible plate is engaged with the at least one aperture by engaging studs extending from two sides of the flexible plate, the flexible plate includes a convex mediate portion which forms a contact surface protruding through the at least one aperture, the contact surface is in contact with the inside of the outer tube.

5. The adjusting mechanism as claimed in claim 4, wherein a frame is connected to the inside of the mediate portion of the operation member and the frame is pivotably connected to the support.

6. The adjusting mechanism as claimed in claim 4, wherein a protrusion extends from the inside of the top end of the operation member and one end of the spring is mounted to the protrusion.

* * * * *